US005249785A

United States Patent [19]

Nelson et al.

[11] Patent Number: 5,249,785

[45] Date of Patent: Oct. 5, 1993

[54] RECONFIGURABLE HOLDING FIXTURE

[75] Inventors: Paul E. Nelson, Tacoma, Wash.; Hugh R. Schlosstein, Renton, Wash.

[73] Assignee: Boeing Commercial Airplane Group, Seattle, Wash.

[21] Appl. No.: 871,321

[22] Filed: Apr. 20, 1992

[51] Int. Cl.[5] ..... B25B 11/00

[52] U.S. Cl. ..... 269/21; 269/266

[58] Field of Search ..... 269/21, 266, 296, 297-301, 269/287, 43

[56] References Cited

U.S. PATENT DOCUMENTS

| | | | |
|---|---|---|---|
| 2,314,319 | 3/1943 | Smith . | |
| 2,885,165 | 5/1959 | Smolen | 269/296 |
| 3,559,980 | 2/1971 | Terai et al. | 269/296 |
| 4,026,535 | 5/1977 | Heath . | |
| 4,381,104 | 4/1983 | Nelsen | 269/266 |
| 4,527,783 | 7/1985 | Collora et al. . | |
| 4,641,515 | 2/1987 | Braun et al. . | |
| 4,684,113 | 8/1987 | Douglas et al. . | |
| 4,691,905 | 9/1987 | Tamura et al. . | |
| 4,723,766 | 2/1988 | Beeding . | |
| 4,792,130 | 12/1988 | Ardent | 269/296 |
| 4,894,903 | 1/1990 | Woods . | |
| 4,946,149 | 8/1990 | Greene . | |

*Primary Examiner*—Robert C. Watson

*Attorney, Agent, or Firm*—Elizabeth F. Harasek; B. A. Donahue

[57] ABSTRACT

A reconfigurable fixture for holding a plurality of workpieces in proper position for manufacturing. The fixture includes an array of interleaved uniformly spaced contoured headers, with a predetermined set of headers corresponding to a predetermined workpiece contour. Each set of contoured headers may be simultaneously laterally displaced from an inactive stored position to a locked, active forward position, wherein the selection and movement of the set of headers is controlled by a computer controller. Each contoured header has a set of vacuum cups, that, when activated, pulls the predetermined workpiece against the contoured edges of the predetermined set of headers.

8 Claims, 4 Drawing Sheets

RECONFIGURABLE HOLDING FIXTURE

BACKGROUND

The present invention relates to a holding fixture, and more particularly to a holding fixture capable of holding predetermined contoured workpieces such as aircraft skin panels.

In manufacturing processes the same workpiece often must undergo several machining operations such as drilling, boring, routing, etc. It is desirable to rigidly fix a contoured workpiece in one position and conduct several machining operations. Further, it is desirable to perform several machining operations in the same location or in a manufacturing "cell" using the same set of work tools for a succession of different shaped workpieces. A workpiece such as an aircraft skin panel must be rigidly fixtured in its correct contour and held during processing. In order to maintain maximum productivity of the manufacturing cell, a change over to the next panel of different curvature should be accomplished as rapidly as possible. Such centrally located processes in a manufacturing cell can greatly reduce manufacturing costs by saving time, increasing efficiency and productivity, reducing manpower requirements, and avoiding machine and retooling expenditures.

Holding fixtures capable of accommodating various contoured workpieces are known in the prior art. For example, U.S. Pat. No. 4,894,903 discloses an aircraft wing skin panel assembly jig using a set of headers, releasably attached to a frame, which corresponds to a particular wing skin panel. A new set of headers can be attached to the frame to accommodate a different wing skin panel. This process however is labor intensive and may not be practical for many manufacturing processes.

U.S. Pat. No. 4,946,149 discloses a programmable working tool bed having a contoured platen containing several retractable workpiece stops, and a plurality of pop-up suction cups to secure workpieces. Similarly, U.S. Pat. No. 4,723,766 discloses a programmable spaced array of retractable vacuum pods supported within a work table wherein the particular known set of vacuum pods is raised and activated to hold a predetermined workpiece.

In addition, U.S. Pat. No. 4,684,113 discloses a matrix of vacuum cup holders housed in a horizontal support table, wherein each cup is attached to a servo actuator and controlled by a computer. This type of holding fixture is sometimes referred to as "a bed of nails" fixture. Although a bed of nails fixture can accommodate a large variety of contours and the contours can be easily altered, each servo actuator is fairly expensive; larger manufacturing applications of this technology often require more than 100 such actuators. The result is a very expensive holding fixture.

SUMMARY OF THE INVENTION

It is a primary object of the present invention to provide a reconfigurable fixture that will accommodate a number of different contoured workpieces in one manufacturing location or cell, to maximize productivity of the cell by providing a means for a very rapid change over or reconfiguration to a holding fixture that will hold a workpiece of a different contour.

A further related object of this invention is to provide, in a reconfigurable holding fixture, greatly reduced costs, substantially lower maintenance and calibration costs and continuous support for enhanced panel rigidity.

The present invention provides a reconfigurable fixture that can accommodate and hold multiple workpieces of different contours. The fixture utilizes an array of rigid vertically aligned holding structures or headers mounted on linear slides. The array is made up of several sets of uniformly spaced interleaved contoured headers, wherein each header set will accommodate the contour of a predetermined workpiece. Each header has a series of vacuum cups that, when activated, suck the workpiece firmly up against the rigid contour of the header.

The present invention provides means for quick and accurate reconfiguration of the fixture. More specifically, each contoured header is mounted on a linear slide such that a set of contoured headers can be advanced by motor driven linear actuators and locked in a forward and active position. Similarly, a set of headers can be retracted and locked in a stored and inactive position. Thus, reconfiguration of the present invention to a new contour is accomplished by causing the linear actuators to retract the set of forward, active contoured headers to the stored, inactive position, and to advance one of the other contoured header sets to the active position.

The above and other objects of the present invention will be more clearly understood from the detailed description that follows taken in conjunction with the features shown in the attached drawings.

DETAILED DESCRIPTION OF THE PREFERRED EMBODIMENT

Figure 1:
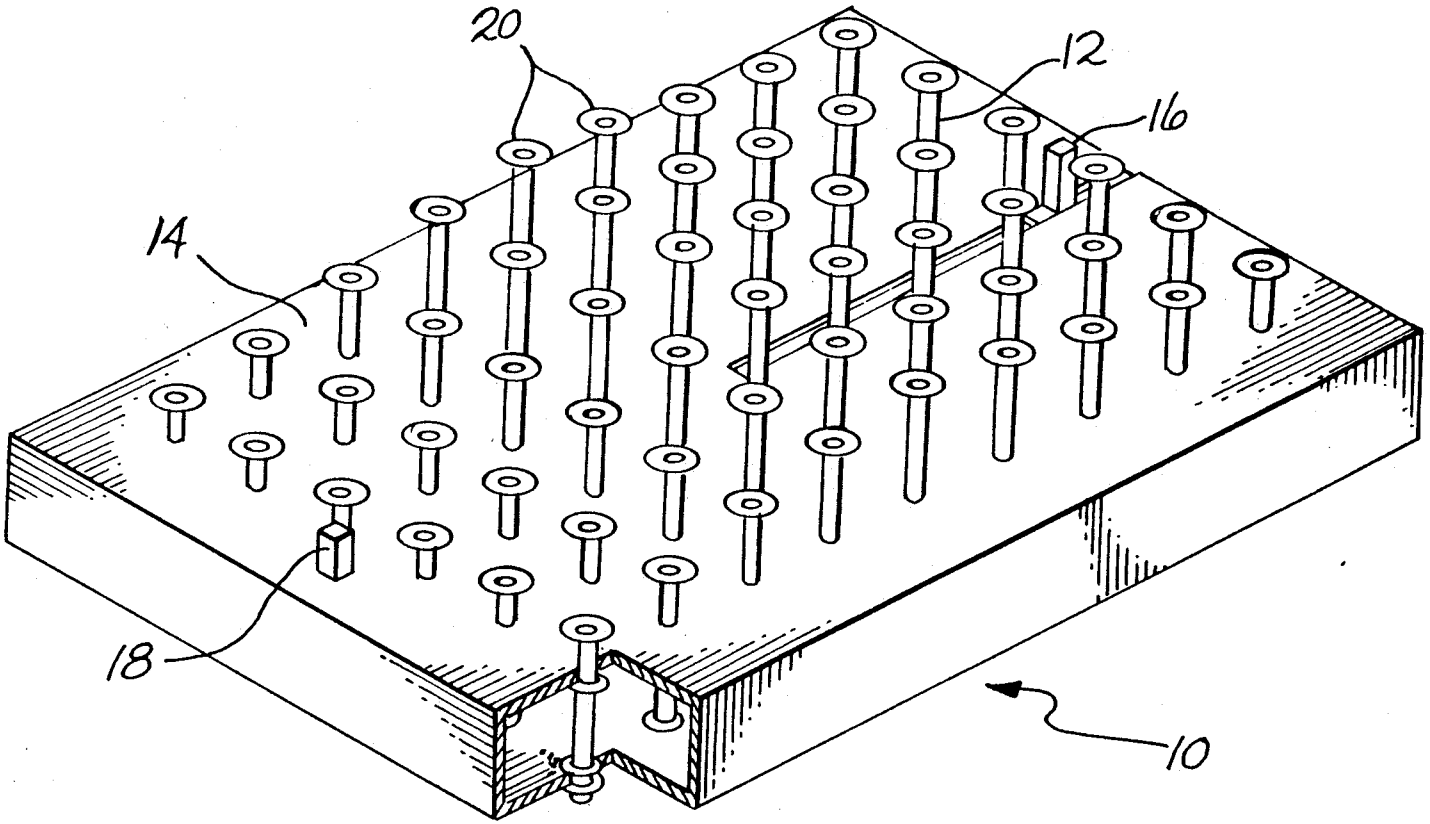
Fig. 1 PRIOR ART
FIG. 1 is a schematic representation of a prior art holding fixture of the "bed of nails" type discussed previously.

FIG. 1 represents a prior art workpiece holding mechanism 10 containing a plurality of adjustable rods 12 within a horizontal support table 14 such that the adjustable rods 12 may be individually raised or lowered relative to the support table 14 as needed to accommodate a contoured workpiece (not shown). Pins 16 and 18 and suction pads 20 function to hold the workpiece in place.

Figures 2, 3:
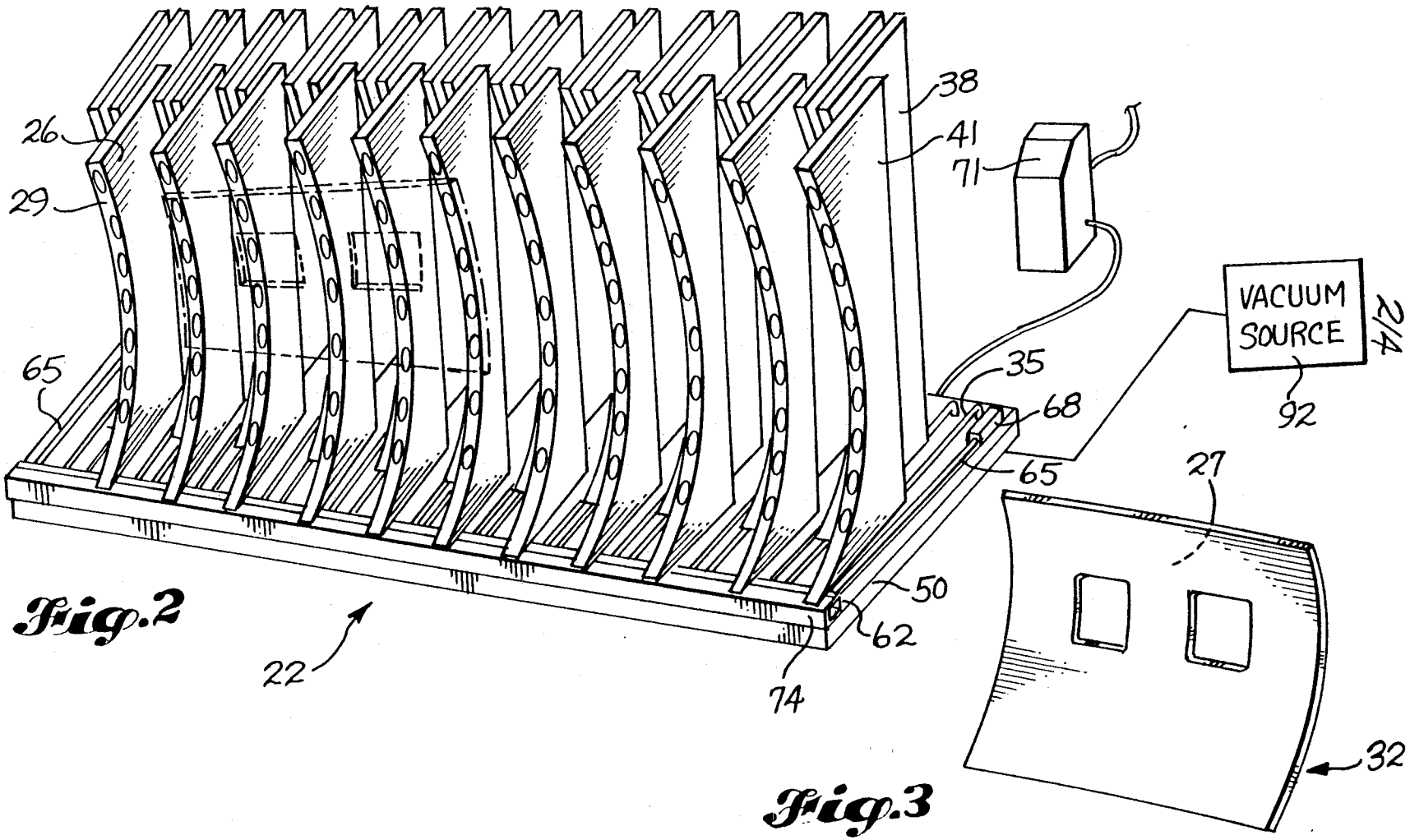
FIG. 2 is a schematic representation of the present invention illustrating the array of headers with one set of headers in the forward active position and the remaining sets of headers in the stored inactive position.
FIG. 3 illustrates, to a reduced scale from that of FIG. 2, a contoured workpiece such as an aircraft fuselage panel.

In accordance with the preferred embodiment of the present invention, as shown in FIG. 2, an array 23 of contoured headers 26 is utilized. The contoured headers 26 are aligned in a vertical, parallel, uniformly spaced, and interleaved manner such that the front edge of headers 26 form a contoured surface 29. Moreover, the contoured surface 29 of a predetermined set of contoured headers 26 correspond to the contours of surface 27 of workpiece 32 (FIG. 3).

Each contoured header 26 is mounted on a lateral slide 35, thereby allowing for a lateral movement of the header 26 between a stored inactive position 38 and a forward active position 41. Lateral slide 35 is mounted on fixture base 50.

Figure 4:
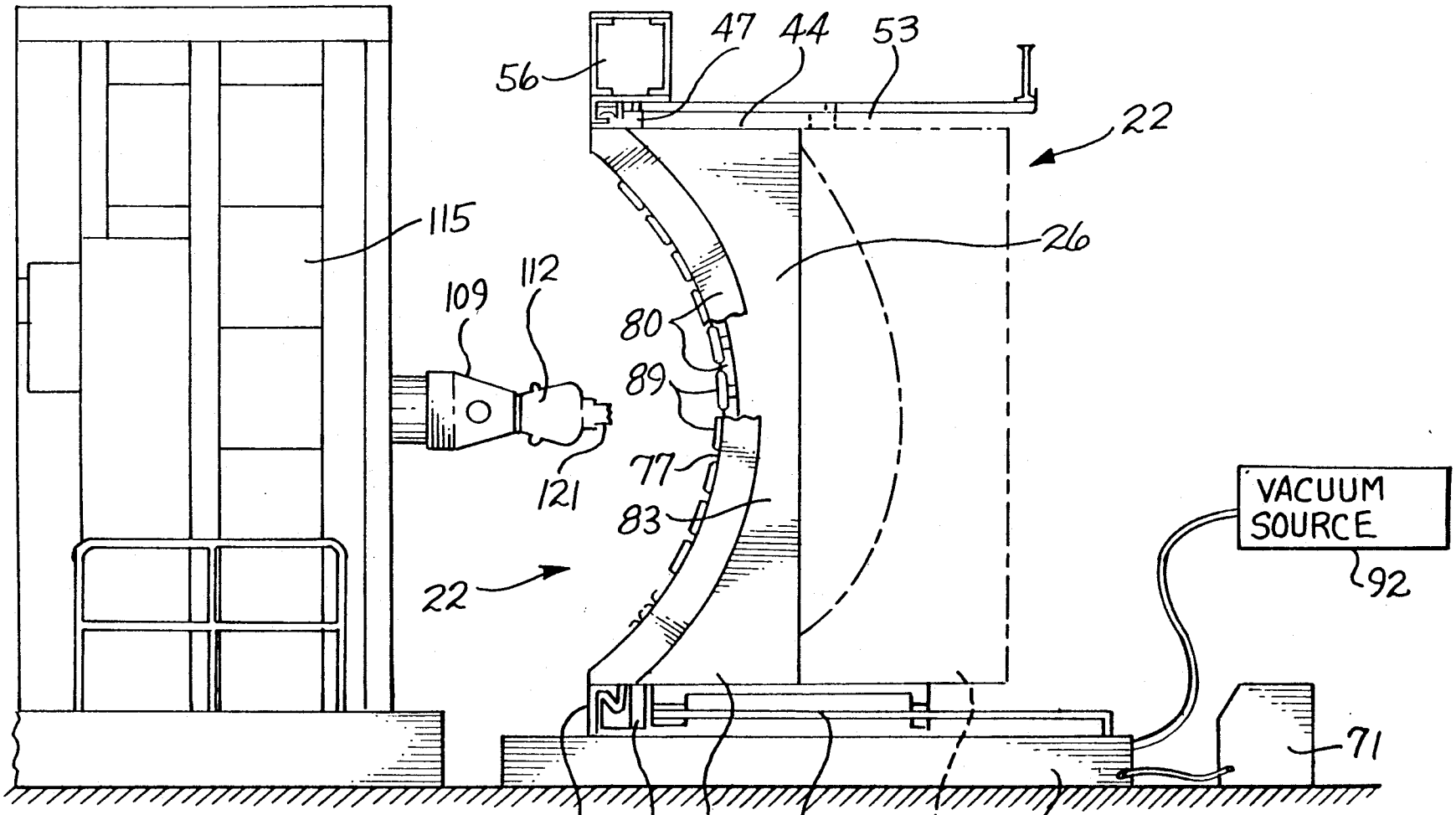
FIG. 4 is a section view of the array of headers with the contoured header in the forward active position and phantom lines representing the contoured header in the stored inactive position.

Referring to FIG. 4, the top edge 44 of contoured header 26 is parallel with lateral slide 35, and includes a slotted guide receiver 47 that translates along a blade guide 53. Blade guide 53, mounted on the upper fixture structure 56, is parallel with lateral slide 35 and oriented such that the contoured header 26 remains vertical.

Referring back to FIG. 2, a predetermined set of contoured headers 26 is laterally and simultaneously displaced between the forward active position 41 and the stored inactive position 38 by temporarily attaching said headers 26 to a positioning bar 62 and laterally displacing the positioning bar 62 to the desired location, where the contoured headers 26 are locked into position. Displacement of the positioning bar 62 is accomplished by simultaneous activation of two electrically synchronized linear actuators 65 driven by electric motors 68. A computer controller 71 is utilized to manage the sequence of actions, such as activating the linear actuators 65, during operation of the fixture 22.

Hence, a predetermined set of contoured headers 26 corresponding to a predetermined workpiece 32 can be unlocked from the stored inactive position 38, temporarily attached to positioning bar 62, laterally displaced along lateral slides 35 by electrically synchronized linear actuators 65 to the forward active position 41, and locked into place by detaching from positioning bar 62 and locking onto a locking bar 74. To reconfigure the holding fixture 22, the workpiece 32 (FIG. 3) is removed from the holding fixture 22 after the vacuum system has been deactivated, the predetermined set of contoured headers 26 are unlocked from the locking bar 74, attached to positioning bar 62, returned and locked into the stored inactive position 38. Then a different predetermined set of contoured headers corresponding to a different predetermined workpiece is moved and locked into the forward active position 41. Such reconfiguration may be accomplished within a very short time period. One practical embodiment of this invention (not shown) utilizes five sets of headers. Each set consists of seventeen contoured headers on a twenty-inch pitch.

Referring to FIG. 4, each contoured header 26 has a contoured face 77 which corresponds to a predetermined workpiece 32 (FIG. 3) made up of two parallel side plates 80 attached to the header body 83. In a preferred embodiment, the parallel side plates 80, milled from aluminum stock, are positioned approximately three inches apart. Although the shape of the side plates 80 is milled before the header 26 is installed into the fixture 22, once installed, the final contours of the plates 80 may be milled again to assure accuracy.

Figure 5:
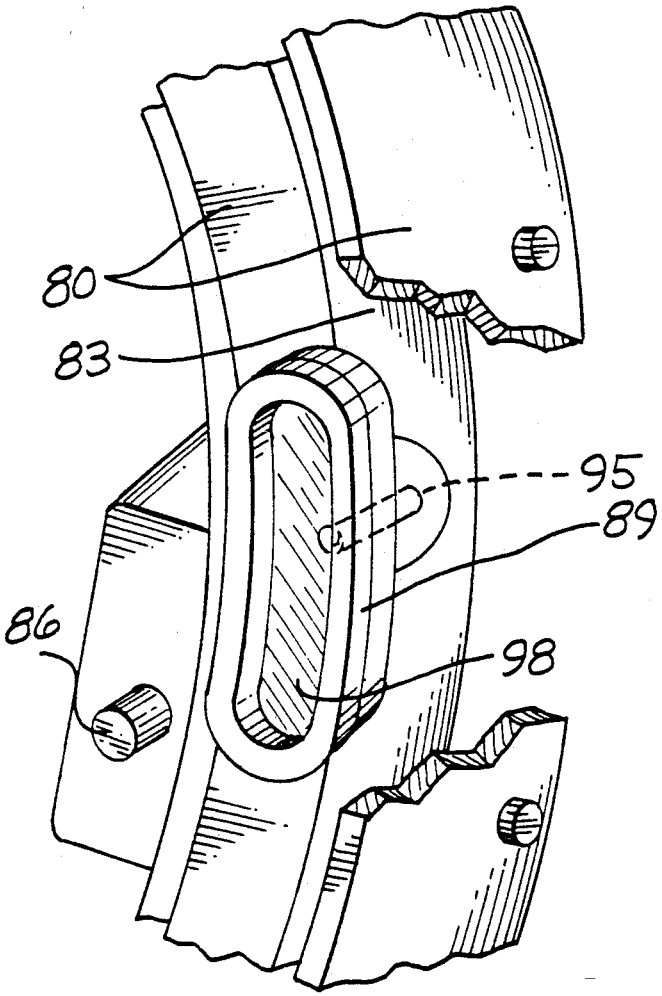
FIG. 5 is a schematic representation of a contoured header containing a vacuum cup constraining mechanism.

To ensure a workpiece 32 (FIG. 3) is accurately positioned on the contoured headers 26 relative to the machining tool 121, workpieces 32 are indexed by locator pins 86 attached to the side plate 80 as indicated in FIG. 5.

As shown in FIG. 4, each contoured header 26 has a plurality of vacuum cups 89 mounted between side plates 80. When the vacuum cups are activated, the workpiece is pulled up to and securely held against the contoured face 77 of the side plates 80. The vacuum holding forces are developed for vacuum cups 89 by a conventional vacuum source 92 which is activated by computer controller 71. In a preferred embodiment, the plurality of vacuum cups 89 in one contoured header 26 may be activated independently from vacuum cups in another header. All vacuum cups 89 within one contoured header are activated simultaneously. However, if the need arises, the vacuum system could be arranged such that each vacuum cup can be independently controlled. Although the preferred embodiment utilizes vacuum cups, other constraining methods may be applied to hold workpieces against the fixture.

Upon activation, vacuum cups 89 provide sufficient holding forces such that a workpiece 32 is firmly held against and supported by contoured headers 26. Once workpiece 32 is accurately positioned and secured on the fixture 22 relative to computer controlled manufacturing tool 115, the desired machining operations may be performed by a robotic arm 109 and end effector 112 utilizing a preselected machining tool 121. Computer controlled manufacturing tool 115 cooperates with a computer controller 71 allowing for coordinated operation between fixture 22 and manufacturing tool 115.

Referring to FIG. 5, each vacuum cup 89 communicates with a conventional vacuum source through a suction port 95. Vacuum cup 89 is made up of a pliable material such that when engaged with a workpiece 32 a sufficient seal will be formed, thereby maintaining adequate holding forces. In addition, a mesh screen 88 within the vacuum cup 89 covers the suction port 95 to protect against damage from ingestion of debris. A further enhancement of the fixture 22 vacuum system includes a vacuum pressure gauge (not shown) and pressure loss warning device (not shown) which work to avoid unintentional damage to a workpiece 32 that may occur upon moving the contoured headers 26 while the workpiece is still rigidly held in position.

Figure 6:
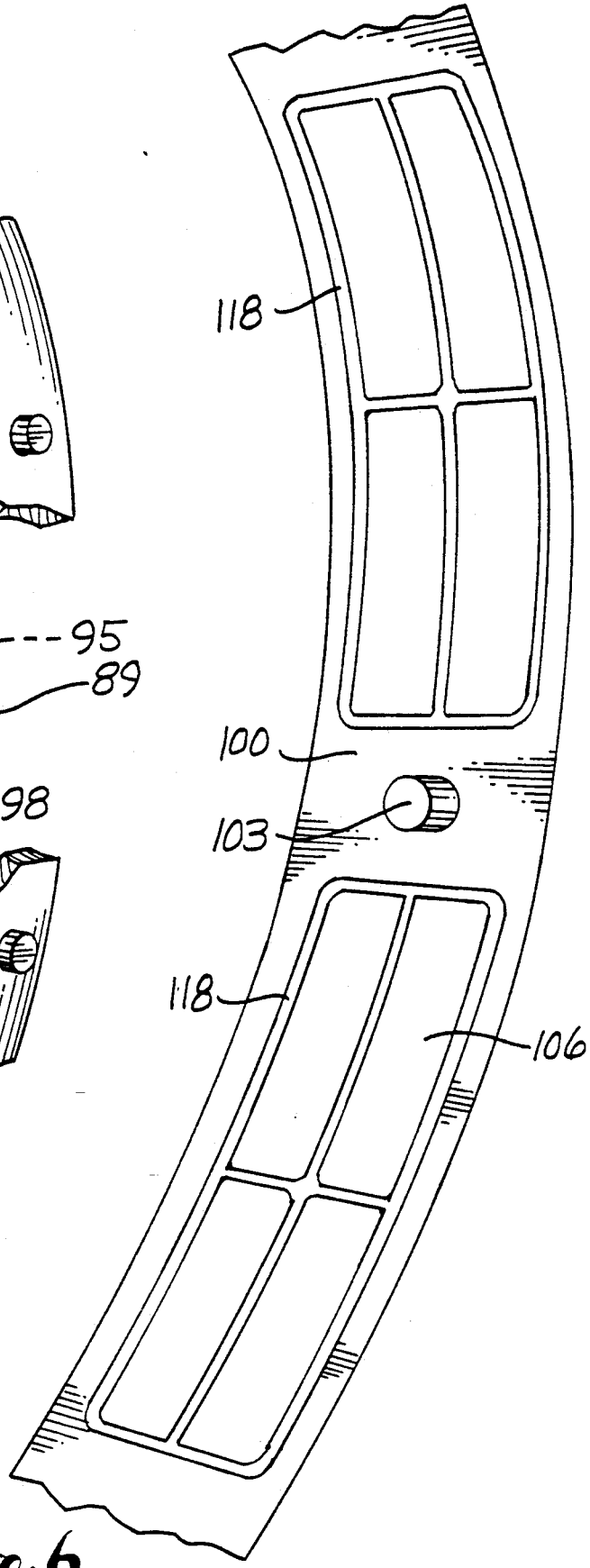
FIG. 6 is a schematic representation of a solid contoured header with integral vacuum chucks.

Referring to FIG. 6, an alternative solid contoured header 100 may be utilized in the present invention, wherein integral locator pins 103 communicate with indexed workpieces (not shown). Integral vacuum chucks 106 communicate with vacuum source 92 (FIG. 4) to generate a sufficient holding force, thereby securing contoured workpiece 32. A vacuum chuck ring 118, made of a pliable material such as rubber, engages the workpiece 32 to form an effective suction seal.

While a particular embodiment of the invention has been described, it will be apparent to persons skilled in the art to which this invention pertains that many modifications and variations thereto are possible without departing from the spirit and scope of the invention.

Accordingly, the scope of this invention should be considered limited only by the spirit and scope of the elements of the appended claims or their reasonable equivalents.

We claim:

1. A reconfigurable workpiece holding apparatus comprising: an array of structures for holding workpieces, said array of structures comprises one or more sets of interleaved contoured headers with predetermined spacing between each said contoured header in each said set, each said header having a contoured front surface to correspond to a predetermined contoured workpiece shape, a top edge coupled to a travel guide, and a bottom edge coupled to a lateral slide mounted to the base of said apparatus;

means for laterally displacing each said contoured header along said lateral slide and said travel guide between an inactive stored position and an active working position, said lateral displacing means comprising movable positioning means to which said contoured headers may be temporarily connected and moving means to move said positioning means and said headers connected thereto between said inactive stored position and said active working position;

means for locking said contoured headers in said active working position, and in said inactive stored position; and locating means associated with said contoured headers for locating a said workpiece in a desired position relative to said contoured headers, said locating means comprising one or more locating pins.

2. The apparatus of claim 1, said moving means further comprising means for simultaneously moving each of said contoured headers in one or more of said interleaved sets of headers forward and backward along said lateral slide and said travel guide.

3. The apparatus of claim 2, each of said contoured headers further comprises constraining means for holding said predetermined workpiece in position, said constraining means comprising a plurality of vacuum cups attached to said contoured headers and individually coupled to a vacuum system, said vacuum system further comprising means for individually activating said vacuum cups in each of said contoured headers while in said active forward position.

4. The apparatus of claim 2, each of said contoured headers further comprise a header body and two parallel side plates with space therebetween, constraining means for holding said predetermined workpiece in position, and constraining means comprising a plurality of vacuum cups mounted in said space between said plates such that said vacuum cups are integral to said front surface of said contoured headers.

5. The apparatus of claim 4 further comprising means for activating said vacuum cups in said contoured headers while in said active forward position.

6. The apparatus of claim 5, said locating means comprising one or more locating pins located on said front surface of said contoured header.

7. A method of configuring a reconfigurable workpiece holding apparatus to secure a workpiece comprising:

unlocking, from a stored inactive position, a set of contoured headers within an array of holding structures, said array of holding structures comprising one or more sets of said contoured headers, each said set of contoured headers corresponding to a predetermined workpiece contour, wherein each said contoured header comprises a front surface, a top edge coupled to a travel guide, a bottom edge coupled to a lateral slide, locating means associated with said contoured headers for locating said workpiece in a desire position relative to said contoured header, said locating means comprising one or more locating pins, and constraining means for holding a said predetermined workpiece, said constraining means comprising vacuum cups attached to said contoured headers;

activating lateral displacing means, said lateral displacing means comprising movable positioning means to which said contoured headers temporarily attach, and moving means to move said positioning means and headers attached thereto between said inactive stored position and active working position:

laterally displacing each of said contoured headers in one of said sets of contoured headers simultaneously along said lateral slide and travel guide from said stored inactive position to said active forward position;

detaching said set of headers from said movable positioning means and locking said set of contoured headers into said forward active position;

activating said vacuum cups attached to each contoured header locked in said active forward position; and positioning said predetermined contoured workpiece on locating means and said front surfaces of said set of contoured headers locked in said forward active position.

8. The method of claim 7 further comprising:

deactivating said set of vacuum cups previously activated;

removing of said predetermined contoured workpiece from said locating means on said set of contoured headers locked in said forward active position;

unlocking said set of contoured headers in said forward active position;

simultaneously laterally displacing with said lateral displacing means each of said contoured headers in said set of contoured headers from said forward active position to said stored inactive position; and locking said contoured headers in stored inactive position.

* * * * *